US006142692A

United States Patent [19]

Garcia

[11] Patent Number: 6,142,692

[45] Date of Patent: Nov. 7, 2000

[54] COSMETIC PRODUCT DISTRIBUTOR INTENDED FOR MAKE-UP

[75] Inventor: Firmin Garcia, Evreux, France

[73] Assignee: Valois S.A., Le Neubourg, France

[21] Appl. No.: 09/251,630

[22] Filed: Feb. 17, 1999

Related U.S. Application Data

[63] Continuation of application No. 08/990,158, Dec. 12, 1997, abandoned.

[51] Int. Cl.[7] ..... A46B 11/02; A45D 40/00; A45D 40/22

[52] U.S. Cl. ..... 401/122; 401/124; 401/129; 401/149; 132/218; 222/321.6; 239/333

[58] Field of Search ..... 401/272, 273, 401/146, 149, 150, 151, 122, 123, 124, 126, 129, 128, 127, 138, 118, 119; 132/218; 222/321.6, 321.9, 378; 239/333; 141/18, 21, 22, 23, 351

[56] References Cited

U.S. PATENT DOCUMENTS

| | | | |
|---|---|---|---|
| 3,237,630 | 3/1966 | Politzer . | |
| 5,002,415 | 3/1991 | Gueret | 401/129 X |
| 5,094,254 | 3/1992 | Krueckel et al. . | |
| 5,096,319 | 3/1992 | Gueret | 401/129 X |
| 5,339,841 | 8/1994 | Gueret | 401/129 X |

FOREIGN PATENT DOCUMENTS

| | | |
|---|---|---|
| 349416 | 1/1990 | European Pat. Off. . |
| 553021 | 7/1993 | European Pat. Off. . |
| 601192 | 6/1994 | European Pat. Off. . |
| 2363299 | 3/1978 | France . |
| 2685858 | 7/1993 | France . |
| 2753060 | 3/1998 | France . |
| 2753061 | 3/1998 | France . |
| 3641389 | 1/1988 | Germany . |
| 3736095 | 5/1989 | Germany . |
| 4105294 | 9/1991 | Germany . |
| 9004068 | 9/1991 | Germany . |
| 2242354 | 10/1991 | United Kingdom . |

OTHER PUBLICATIONS

International Search Report for EP 97 40 3020.
International Search Report for EP 97 40 3021.
French Patent Office Preliminary Search Report for French Application FA 534451 (FR 9610950).

*Primary Examiner*—Henry J. Recla
*Assistant Examiner*—Kathleen J. Prunner
*Attorney, Agent, or Firm*—Darby & Darby

[57] ABSTRACT

A distributor for a cosmetic product, in fluid or paste form, intended for make-up, in particular to a mascara distributor, comprising on the one hand a distributor body (C) which comprises a seating (29) for an applicator member (3) and, on the other hand, a gripping element (E) which comprises a capsule (1) provided with a rod (2) bearing the applicator member (3) at one of its ends which projects from the capsule. The capsule being capable of being assembled in a removable manner on the distributor body (C) and capable of being gripped by a user in order to apply the cosmetic product. A reservoir (8) for the cosmetic product is, moreover, provided and associated with a feed device intended to introduce successive doses of the cosmetic product into the seating (29) of the applicator member (3) from the reservoir (8). The reservoir (8) is situated in the capsule (1) and the feed device comprise a pump (10) which is likewise arranged in the capsule, the operation of the pump (10) being caused by a relative movement of the reservoir (8) in relation to the distributor body (C).

12 Claims, 3 Drawing Sheets

COSMETIC PRODUCT DISTRIBUTOR INTENDED FOR MAKE-UP

Related Application

The application is a continuation of application Ser. No. 08/990,158, filed Dec. 12, 1997, now abandoned.

The invention relates to a distributor for a cosmetic product, in fluid or paste form, intended for make-up, in particular to a mascara distributor, of the type of those which comprise a distributor body with a seating for an applicator member, and a gripping element comprising a capsule provided with a rod bearing the applicator member at an end projecting from the capsule, which can be assembled in a removable manner on the distributor body and can be gripped by a user in order to apply the product, a cosmetic product reservoir furthermore being provided together with product feed means for introducing successive doses of product into the seating of the applicator member from the reservoir.

A cosmetic product distributor of this type is known, in particular from FR-B-2 685 858.

According to the embodiment in FIG. 1 of that document, the cosmetic product reservoir and the means for feeding the seating of the applicator member are provided in the distributor body. In order to cause a dose of product to emerge, it is necessary to exert pressure on the capsule, which pressure is transmitted by the rod, over its entire length, and by the applicator member to an actuating member of the product feed means. The repeated compressive forces to which the rod is subjected make it necessary to provide a sufficiently large rod cross-section. Furthermore, the mechanical stressing of the applicator member results in deterioration of this applicator member.

The embodiment shown in FIGS. 2*a* and 2*b* of this prior document shows a distributor in which the body and the gripping element form an entity. The seating for the applicator member provided at one end of the gripping assembly is closed by a lid. The applicator member is pushed through the drier in a manner such that the rod which transmits the compressive force has to have a sufficient diameter. Furthermore, the assembly formed by the distributor body and the gripping element is bulky to manipulate; this assembly is relatively complex to install, particularly as regards the production of the seating of the applicator member.

The object of the invention is, in particular, to provide a cosmetic product distributor of the type defined above which, while keeping the product as well protected from air as possible in order to avoid its contamination, is simple and economical to manufacture and reliable to use. The gripping element must be easy to manipulate. Preferably, it is desirable for the distributor to allow successive doses of product to be distributed into the seating of the applicator member with a minimum of mechanical stressing of the rod and of the applicator member.

According to the invention, a cosmetic product distributor of the type defined above is characterized in that the product reservoir is situated in the capsule and in that the means for feeding the product to the seating comprise a pump which is likewise arranged in the capsule, the operation of the pump being caused by a relative movement of the reservoir in relation to the distributor body.

Such a distributor is simple to manufacture and the gripping element with the reservoir is easy to manipulate. The cosmetic product is well protected from air.

The pump is a pump without an air inlet (known as an "airless" pump) which comprises, conventionally, a pump body and a valve having a valve tube that is movable in translation relative to the pump body; advantageously, the rod bearing the applicator member possesses a base at its end remote from the brush, which base serves as a stop for the valve tube in order to control its movements. Preferably the rod is solidly fixed by its base, in particular by adhesive bonding, to the valve tube.

The means for feeding the seating can thus be controlled with minimum stressing of the rod bearing the applicator member.

The capsule comprises an external cylindrical shell provided with means for assembly with the distributor body, in particular a fret, and the reservoir comprises a cylinder arranged in the shell and provided, at its end facing the distributor body, with the pump whose valve tube projects through a transverse wall closing the reservoir cylinder.

The reservoir cylinder may be mounted to slide in the capsule shell, while the base of the rod bearing the applicator member is linked in translation to the capsule shell and, in the closed position of the distributor, in which the capsule is assembled on the body, a free space exists between the bottom of the reservoir provided with the pump and the base of the rod closing the capsule, the valve of the pump then being in the closed state, actuating means being provided to enable the reservoir and the pump body to be displaced, in particular before separation of the capsule and the body, to deliver a dose of product into the seating of the applicator member.

Preferably, the shell of the capsule is open at its end opposite the distributor body and a push-rod, which forms the said actuating means, is provided at the end of the reservoir remote from the pump.

According to an alternative embodiment, the reservoir cylinder is linked in translation to the capsule shell, while the rod bearing the applicator member is free in translation relative to this shell and, in the closed position of the distributor, in which the capsule is assembled on the body, the base of the rod is bearing against the bottom of the reservoir provided with the pump, the valve of the pump being in the open state, while the valve is in the closed state when the capsule and the body are separate, actuating means being provided to enable the rod and the valve tube to be displaced during assembly of the capsule and the body in order to deliver a dose of product into the seating of the applicator member.

Advantageously, the rod bearing the applicator member possesses an internal duct which extends from the base of the rod, where it communicates with the outlet of the pump, to the applicator member.

This internal duct, preferably coaxial with the rod, opens at the level of the applicator member through holes which are radially oriented and regularly distributed around the periphery. For example, four holes at an angular offset of 90° are provided to this end. The outlet holes for the cosmetic product are provided at the head of the applicator member, that is to say towards the end of this applicator member situated nearer to the base of the rod, so that when the rod is extracted by traction, through a drier, the latter ensures the distribution of the product over the entirety of the applicator member.

The body of the distributor may be formed by a sheath in which are arranged two superposed coaxial sleeves, with a drier situated in the vicinity of the separation interface of the sleeves, the seating for the applicator member being provided in the sleeve more remote from the capsule.

The drier may be formed by a constriction of the internal passage of the sleeve closer to the capsule, or by a washer of flexible material gripped between the neighbouring frontal ends of the sleeves.

As is customary in distributors of this type, the gripping element is preferably assembled on the distribution body in a leaktight manner; the leaktightness of this assembly may be achieved by the addition of a seal.

The invention, apart from the arrangements set out above, resides in a number of other arrangements which will be discussed in more detail below in connection with particular examples of embodiment described with reference to the attached drawing, which examples of embodiment are however in no way limitative.

Figure 6:
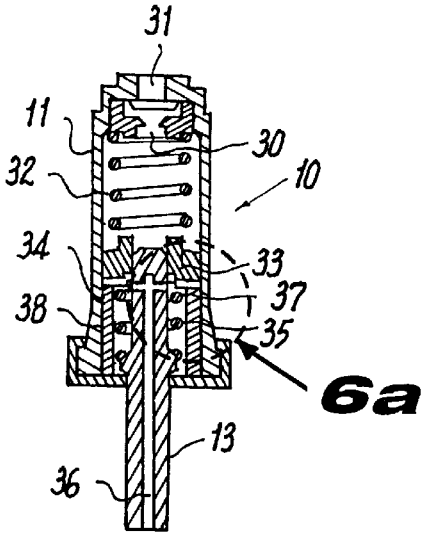

FIG. 6, finally, is an axial section of a pump without air inlet.

Figure 6A:
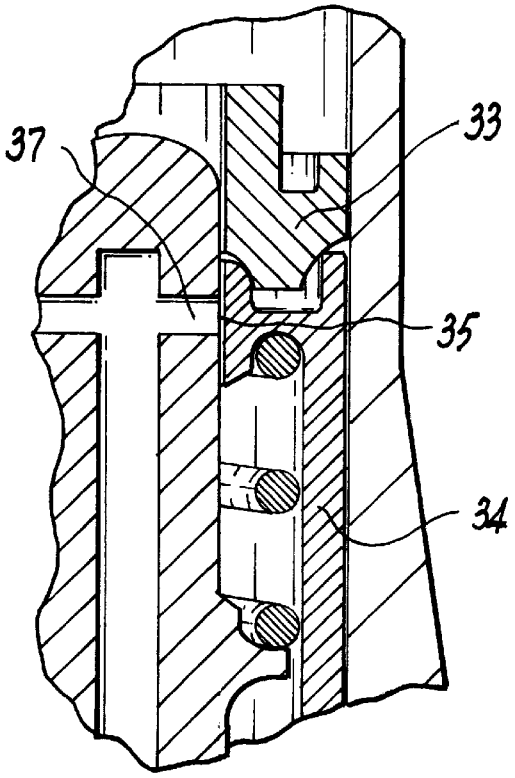

FIG. 6*a* is an enlarged view of a portion of FIG. 6.

Figure 1:
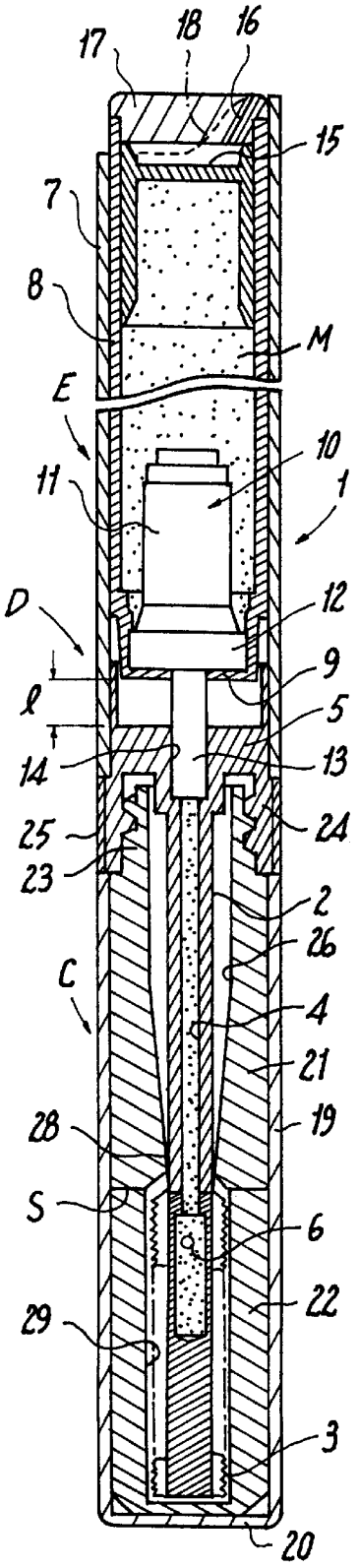
FIG. 1 is a longitudinal axial section, with part removed, of a cosmetic product distributor according to the invention, in the closed state, and at rest.
Figure 2:
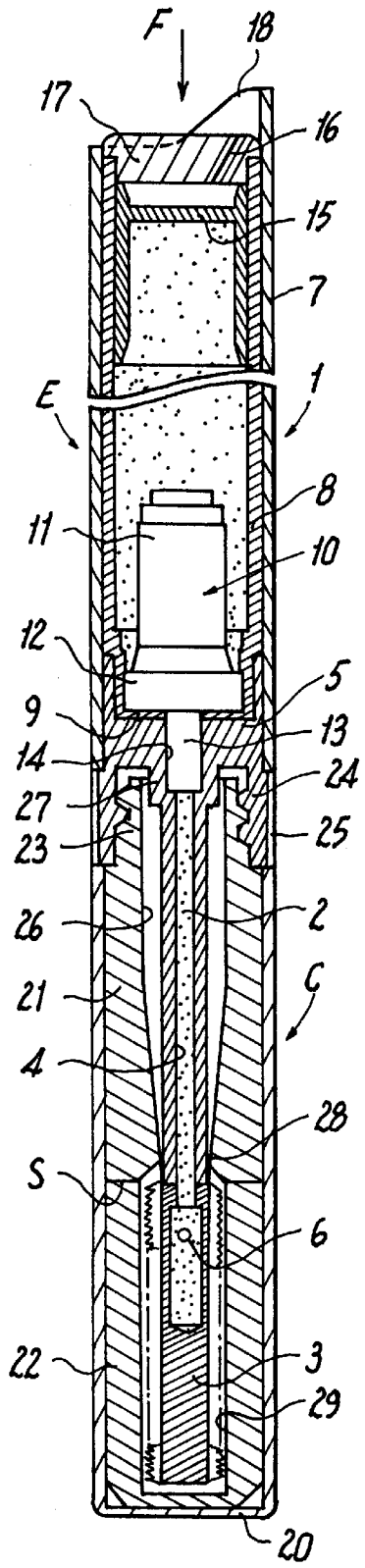
FIG. 2 shows, in a manner similar to FIG. 1, the distributor device in the closed state but on completion of the injection of a dose of product into the seating of the applicator member.

By referring to the drawing, in particular to FIGS. 1 and 2, it is possible to see a distributor D for a cosmetic product in fluid or paste form which is intended for make-up, in particular for mascara M. This distributor comprises a distributor body C and a gripping element E comprising a capsule 1 provided with a rod 2 bearing an applicator member 3 at an end projecting from the capsule 1. In the example shown, 30 the applicator member is formed by an externally grooved plastic cylinder. It is to be noted that the term "applicator member" must be understood in a very general sense as encompassing not only the member described but any applicator member, for example a brush comprising helically wound threads or a sponge, or an external flocking.

The rod 2 possesses a coaxial internal duct 4, extending from a base 5 of the rod to the applicator member 3. The channel 4 opens, at the level of this applicator member, through holes 6 which are radially oriented and angularly distributed over the entire periphery of the applicator member. In the example shown, four holes 6, spaced apart at an angle of 90°, are provided; their number may of course be different. The diameter of the holes 6 is adapted to the viscosity of the product.

The holes 6 are positioned at the head of the applicator member 3, that is to say towards the end of that member situated towards the rod 2 and the base 5, so that, in the case of a drying, which will be discussed in due course, carried out by withdrawing the rod 2 by a traction movement, the product delivered through the holes 6 is distributed over the entire length of the applicator member 3.

The base 5 is engaged in, and fixed to, the end of a cylindrical shell 7 of the capsule. A cosmetic product M reservoir 8 is arranged in the shell 7.

The reservoir 8 is formed by a cylinder whose external diameter is equal to the internal diameter of the shell 7. The reservoir 8 is closed at its end facing the base 5 by a transverse wall 9 which is the bottom of the reservoir 8. Product feed means, appropriate for supplying successive doses, are arranged in the reservoir 8 and comprise a pump 10 without air inlet ("airless" pump). The pump 10 comprises a housing 11, coaxial with the cylinder 8 and fixed against the transverse wall 9, particularly by dipping a peripheral projecting rim 12 of the pump into an annular groove provided on the interior of the cylinder 8. A cylindrical valve tube 13, of lesser diameter than the internal diameter of the cylinder 8, passes through a central aperture provided in the wall 9 and is received, by its end remote from the housing 11 in a bore 14 of the base 5, communicating with the duct 4. The tube 13 possesses an axial channel. The pump 10 with its housing 11 and its tube 13 will be described in detail in due course, with reference to FIG. 6.

The tube 13 may be displaced in axial translation relative to the housing 11 of the pump 10 to cause the emergence of a dose of product. The combination of the tube 13 and of a bore linked to the housing forms a valve. The tube 13 is solidly fixed to the base 5, for example by adhesive bonding of the part of this tube 13 engaged in the seating 14.

The reservoir 8 is filled, initially, with cosmetic product M which surrounds the pump housing 11 which possesses an aperture 31 (FIG. 6) for the entry of the product. A follower piston 15 closes the cylinder 8 at its end opposite the wall 9, in a manner such as to keep the product M protected from air and avoid its contamination. The surface of the piston 15 opposite the housing 11 is subjected to atmospheric pressure. An air inlet 16 is provided in a push-rod 17 mounted at the upper end of the reservoir 8, so that the face of the piston 15 opposite the housing 11 is subjected to atmospheric pressure.

The shell 7 is opened at its end remote from the distributor body C and its edge exhibits a horizontal flexure 18 giving access, over a sufficient distance, to the push-rod 17. The reservoir 8 is mounted to slide within the shell 7. In the position of rest of the push-rod 17, as shown in FIG. 1, a free space exists between the bottom of the reservoir 8 and the base 5 of the rod 2.

The distributor body C comprises a cylindrical sheath 19, whose end neighbouring the capsule 1 is open and whose other end is closed by a bottom 20. Two superposed sleeves 21, 22 are arranged in this sheath. The sleeve 21 situated on the side of the capsule 1 projects beyond the end of the sheath 19 with an externally threaded part 23 of smaller diameter. The base 5 is solidly fixed to a collar 24 bearing an internal thread complementary to that of the extension 23. The ring 24 and the extension 23, by means of their threads, form means for assembling the capsule 1 and the body C.

The ring 24 may be surrounded by a spacer band 25, for example a decorative band, whose outer surface is in alignment with the outer surfaces of the sheath 19 and of the capsule 1, of the same diameter.

The sleeve 21 possesses a central internal passage 26 in which is freely engaged the rod 2 and its zone 27 of connection to the base 5. The passage 26 gradually reduces in diameter, forming a frustoconical surface, towards the sleeve 22 in order to form a constriction 28 of lesser diameter in the vicinity of the zone of separation between the two sleeves 21 and 22. This constriction 28 forms a drier whose diameter is only slightly greater than that of the rod 2 and is less than the external diameter of the applicator member 3.

The sleeve 22, situated against the bottom 20 of the sheath 19, possesses a coaxial seating 29 communicating with the passage 26 and closed at its end neighbouring the bottom 20. This seating 29 is intended to receive the applicator member 3 when the capsule 1 is assembled on the body C. The holes 6, when the distributor is in the closed position, are to be found in the part of the seating 29 close to the separation surface S of the two sleeves 21, 22.

The introduction of the successive doses of product into the seating 29 is undertaken by the pump 10, forming the means of feeding product to this seating.

As shown in FIG. 6, the pump 10, conventionally, possesses within its housing 11 a flap 30 arranged against the aperture 31 whereby the housing 11 communicates with the interior of the reservoir 8. The flap 30 is maintained against the aperture 31 by a helical spring 32 which bears, at its other end, against a sliding ring 33 which itself bears against a sleeve 34 in which the tube 13 can slide. This sleeve 34 is provided with a cylindrical bearing portion 35 in which the tube 13 slides with reduced play. This tube possesses a blind axial channel 36 opening to the outside. The channel 36 is connected to the exterior surface of the tube 13, in the vicinity of its blind end, by radially oriented drilled holes 37 which, in the position of rest of the valve 10, are closed by the bearing portion 35. A helical spring 38 is arranged between a peripheral shoulder of the tube 13 and the bottom of the sleeve 34.

When the tube 13, under the action of a thrust, enters into the housing 11, compressing the spring 38, product under pressure contained in the housing 11 can escape through the drilled holes 37 and the channel 36, once the drilled holes 37 communicate with the interior of the housing 11; in this phase, the flap 30 remains closed and pressed against its seat.

When the thrust on the tube 13 ceases, this tube can resume its position of rest, or closed position, and the spring 32 can push back the ring 33, causing product to be aspirated into the housing 11 through the aperture 31 and the flap 30, which opens.

The use and manner of operation of the distributor according to the embodiment shown in FIG. 1 are described below.

When the distributor D is in the closed state, shown in FIG. 1, the capsule 1 is assembled on the body C by screwing, in a leaktight manner, and the tube 13 of the pump 10 is in the position of closure illustrated in FIG. 6; a space l exists between the reservoir transverse wall 9 and the base 5.

The user, before separating the capsule 1 from the body C, exerts pressure with a finger on the pushrod 17 as indicated by the arrow F in FIG. 2. The reservoir 8 slides within the shell 7, entraining the pump housing 11, while the tube 13 linked to the base 5 remains immobile relative to the shell 7. The tube 13 thus penetrates into the housing 11 when the transverse wall 9 comes to bear against the base 5.

The valve of the pump 10 is thus open and a dose of cosmetic product M is delivered through the channel 36 of the tube 13 into the duct 4 of the rod 2 and, through the holes 6, into the seating 29 of the applicator member 3.

When the user relaxes his effort on the pushrod 17, the housing 11 of the pump, under the action of the springs 32 and 38, resumes the position illustrated in FIG. 1 and a quantity of matter, equal to the dose that has been delivered, penetrates into the housing 11 through the flap 30, which opens. The follower piston 15 moves slightly closer to the housing 11, in correspondence with the volume of product that has entered the housing 11.

The user then unscrews the capsule 1 to separate it from the body C by a traction movement, holding the capsule 1 in one hand and the body C in the other. The rod 2 is drawn relative to the body C, and the applicator member 3 passes through the drier 28 which distributes the dose of product, injected at the head of the brush, over the entire length of this brush.

The make-up is then applied with the gripping element E held by the capsule 1 in which the product reservoir 8 is located.

With the distributor according to the invention, the product M is well protected from air since the pump 10 operates without an air inlet, the piston 15 isolating the product from the ambient air.

Furthermore, the feed of doses of product to the applicator member 3 and to the seating 29 takes place via the interior of the rod 2 through the holes 6, which allow the emergence of a dose which has been bacteriologically protected until it is ejected onto the applicator member 3. This makes it possible to avoid adding preservatives to the product compositions or to reduce the proportion thereof.

The compressive force necessary to eject a dose of product is essentially exerted between the base 5 and the reservoir transverse wall 9, over a short axial length, without being exerted on the rod 2 possessing the internal channel 4. This rod 2 and the applicator member 3 are therefore not stressed by the effort necessary to eject a dose. Furthermore, the gripping element E remains easy to manipulate, since the body C in which the seating 29 is located is separated from the element E during making-up.

Figure 3:
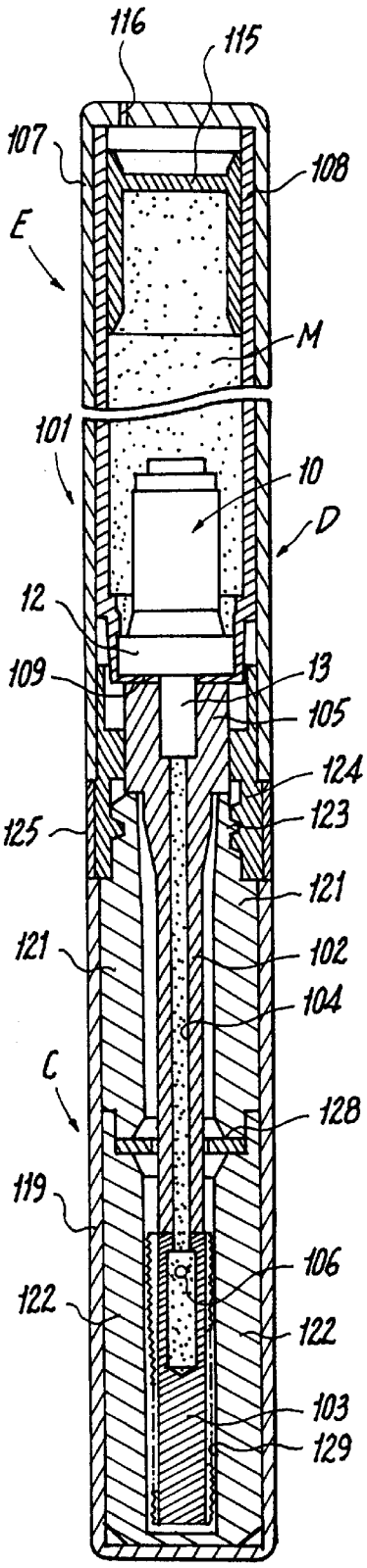
FIG. 3 is an axial longitudinal section, with part removed, of an alternative embodiment of the distributor, in the closed position.
Figure 4:
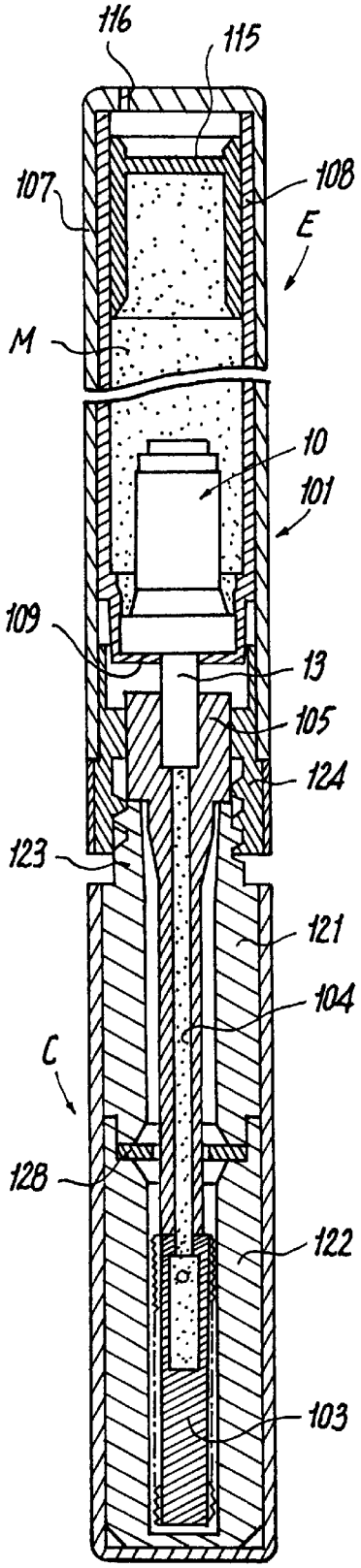
FIG. 4 shows, likewise in longitudinal axial section, the distributor of FIG. 3 in the course of opening.
Figure 5:
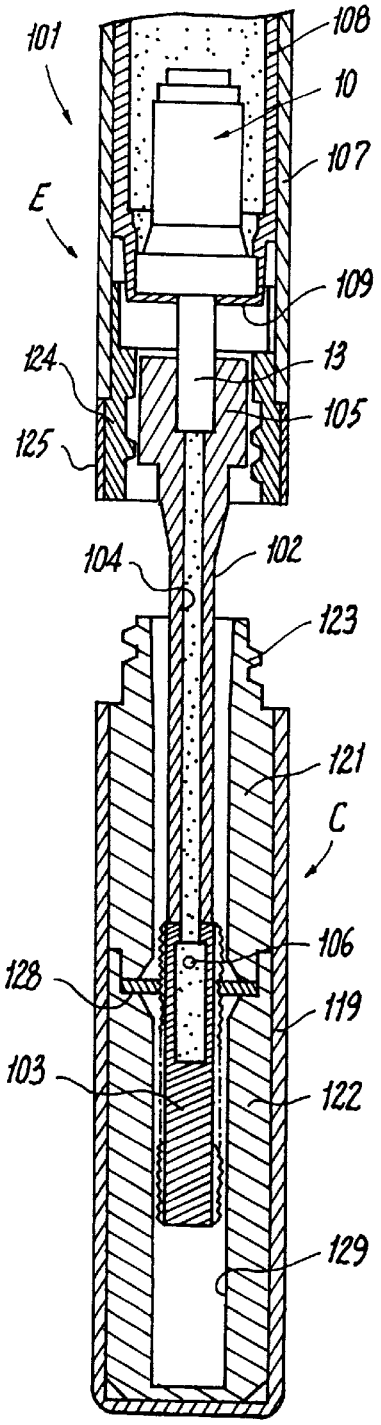
FIG. 5 shows, in longitudinal axial section, a part of the distributor of FIG. 3 after separation of the capsule and the reservoir, the drying of the applicator member being in progress.

Referring to FIGS. 3 to 5, there is illustrated an alternative embodiment of the distributor D according to FIGS. 1 and 2. Elements of FIGS. 3 to 5 which are identical to, or play similar roles to, elements already described in connection with FIGS. 1 and 2 will be designated by the same references or by numerical references equal to the sum of the number 100 and the numerical reference used in FIGS. 1 and 2; their description will not be repeated or will be given briefly.

In this alternative embodiment, the reservoir 108 is linked in translation with the shell 107, while the rod 102 and its base 105 are free in translation relative to the said shell 107 and to the ring 124.

In the closed position of the distributor, as shown in FIG. 3 when the gripping element E and its shell 107 are screwed in a leaktight manner on the body C, the base 105 is gripped between the upper edge of the sleeve 121 and the reservoir transverse lower wall 109 of the reservoir 108. The tube 13 of the pump 10 is immersed in the housing 11, which corresponds to the open position of the valve tube 13. There is thus communication between the interior of the housing 11 and the channel 104. In the open position of the distributor, shown in FIG. 5, when the gripping element E and the capsule 101 are totally unscrewed from the body C, the tube 13 is in its position of closure, the base 105 of the rod 102 being moved away from the tranverse wall 109.

In the case of FIGS. 3 to 5, the drier 128 is formed by a washer of resilient material gripped between the neighbouring faces of the sleeves 121 and 122.

The operation of the distributor according to FIGS. 3 to 5 is describe below.

When the user, starting from the open position shown in FIG. 5, closes the distributor by screwing the gripping element E and the capsule 101 onto the body C in a leaktight manner, this causes the entry of the tube 13 into the pump housing 11 and the sending of a dose of cosmetic product into the seating 129 through the channel 104.

The dose thus distributed remains in the seating 129 pending the next make-up operation.

FIG. 4 shows what happens at the start of the unscrewing of the gripping element E. The valve tube 13 gradually emerges from the housing 11 until it reaches its position of complete closure before the rod 102 and its base 105 are driven in translation by this tube 13 linked to the base 105. At the end of the extraction of the rod 102, the applicator member 103 passes through the drier 128.

The advantages explained in connection with FIGS. 1 and 2 are retained in the embodiment according to FIGS. 3 to 5.

I claim:

1. A distributor for a cosmetic product, which is in fluid or paste form, the distributor comprising:

a distributor body having a seating for an applicator member;

a gripping element removably connected to said distributor body to be gripped by a user in order to apply the cosmetic product and including a capsule having a rod, a reservoir, a pump, and an outer shell, said rod bearing said applicator member at a first end thereof projecting from said capsule and having a base end opposing said reservoir, said capsule being removably mounted relative to said distributor body;

said reservoir for storing the cosmetic product being fixedly secured within said capsule and associated with said pump to introduce successive doses of the cosmetic product into said applicator member from the reservoir;

said pump having a pump body with an inlet connected to said reservoir and a valve tube for the outlet of the pumped product, said distributor body covering said rod and applicator member when assembled to said capsule, said valve tube being movable in translation relative to said pump body to open and close said pump, operation of said pump being caused by a relative movement of said capsule in relation to said distributor body;

said outer shell including connection means for connecting said capsule to said distributor body; and said capsule being fixedly attached to said outer and said rod being free to move in translation axially relative to said reservoir as said outer shell connecting means connects said capsule to said distributor body;

wherein in the closed configuration of the distributor, with said capsule being mounted on said distributor body, said base end of said rod abuts a bottom surface of said reservoir and said valve tube places said pump in an open configuration; and wherein said valve tube places said pump in a closed configuration when said capsule and said distributor body are separated; and wherein the rod and the valve tube are displaced during assembly of said capsule to said distribution body to deliver a dose of product into said applicator member.

2. The distributor according to claim 1, wherein said rod base end serves as a stop for said valve tube relative to said pump body in order to control the movements of said valve tube.

3. The distributor according to claim 2, wherein one end of said valve tube is fixed to said rod base end.

4. The distributor according to claim 1, wherein said rod includes an internal duct extending from said base end to said applicator member, and wherein the internal duct provides a communication path with the outlet of said pump.

5. The distributor according to claim 1, wherein said distributor body includes a sheath having therein two superposed coaxial sleeves, with a drier disposed substantially adjacent to a separation interface of said sleeves, wherein said applicator member is disposed in a first one of said sleeves disposed relatively remote from said capsule.

6. The distributor according to claim 5, wherein said drier is formed by a constriction of the internal passage of a second one of said sleeves positioned relatively close to said capsule.

7. The distributor according to claim 6, wherein said drier includes a washer of flexible material gripped between frontal ends of said sleeves.

8. The distributor according to claim 1, wherein said gripping element is disposed on said distributor body to form a leaktight configuration.

9. A distributor for a cosmetic product, which is in fluid or paste form, the distributor comprising:

a distributor body; and a gripping element removably connected to said distributor body including:

a capsule grippable by a user to apply the cosmetic product;

a rod projecting from said capsule bearing an applicator member at a first end thereof and having a base at the other end thereof;

a reservoir fixedly secured in said capsule for storing the cosmetic product; and a pump having a pump body with an intel connected to said reservoir and an outlet, and a valve tube for the supply of the pumped product from said pump outlet to said rod base end, said distributor body covering said rod and applicator member when assembled to said capsule, said valve tube being movable in translation relative to said pump body, with operation of said pump being caused by a relative movement of said capsule in relation to said distributor body by assembling said capsule to and removing it from said distributor body, said reservoir being associated with said pump body to cause successive doses of the cosmetic product to flow from the reservoir, wherein said valve tube seats into said pump body outlet to stop the supply of the product to said base end.

10. The distributor according to claim 9, wherein said rod base end serves as a stop for said valve tube to control the movements of the valve tube.

11. The distributor according to claim 10, wherein one end of said valve tube is fixed to said rod base end.

12. A distributor for a cosmetic product, the distributor comprising:

a distributor body having a seat for an applicator member; and a gripping element removably connected to said distributor body including:

a capsule having a rod, a reservoir, a pump, and an outer cylindrical shell, said rod projecting from said capsule and bearing said applicator member at a first end thereof, said capsule being removably mounted on said distributor body and wherein said capsule is capable of being gripped by a user in order to apply the cosmetic product;

said reservoir for storing the cosmetic product being fixedly secured in said capsule and being associated with said pump to cause successive doses of the cosmetic product to flow from said reservoir;

said pump having a pump body with an inlet connected to said reservoir and a valve tube for the outlet of the pumped product, said distributor body covering said rod and applicator member when assembled to said capsule, said valve tube being movable in translation relative to said pump body, operation of the pump being caused by a relative movement of said capsule in relation to said distributor body during assembly and dissassembly of said capsule to said distributor body;

said rod including an internal duct extending from a base of said rod to said applicator member, with said internal duct providing a communication path with the outlet of said pump;

an outer cylindrical shell including means for connecting said capsule to said distributor body; and said reservoir includes a cylinder disposed in said outer cylindrical shell and having said valve tube of said pump projecting through a transverse wall for closing the cylinder of the reservoir.

* * * * *